United States Patent [19]

Kobayashi

[11] Patent Number: 4,512,108

[45] Date of Patent: Apr. 23, 1985

[54] LENS WORKING APPARATUS

[75] Inventor: Takahide Kobayashi, Kawasaki, Japan

[73] Assignee: Koken Co., Ltd., Japan

[21] Appl. No.: 417,575

[22] Filed: Sep. 13, 1982

[30] Foreign Application Priority Data

Apr. 16, 1982 [JP] Japan ..... 57-64497

[51] Int. Cl.[3] ..... B24B 7/00

[52] U.S. Cl. ..... 51/101 LG

[58] Field of Search ..... 51/101 LG

[56] References Cited

U.S. PATENT DOCUMENTS 3,332,172 7/1967 Stern ..... 51/101 LG

FOREIGN PATENT DOCUMENTS 1777393 7/1980 Fed. Rep. of Germany ..... 51/101 LG

*Primary Examiner*—James G. Smith

*Assistant Examiner*—J. T. Zatarga

*Attorney, Agent, or Firm*—Cushman, Darby & Cushman

[57] ABSTRACT

A lens working apparatus permitting the formation of a circumferential rib on the edge of a lens for exact fit in a lens rim with interengagement of the circumferential rib and a V-shaped groove on the inner edge of the lens rim. Smooth formation of the rib is achieved by controlling axial positioning of the lens blank relative a grindstone in accordance with a defined contact angle formed between a lens model and a lens model partner piece. The lens model is fixedly rotated with the lens blank, and the changing contact angle is continuously monitored to control axial alignment of the lens blank.

6 Claims, 9 Drawing Figures

LENS WORKING APPARATUS

BACKGROUND OF THE INVENTION (a) Field of the Invention

This invention relates to a lens working apparatus for profiling a lens blank to form a circumferential rib on the edge of the lens blank.

(b) Description of the Prior Art

In general, spectacle lens are formed by profiling a model to work the new lens into exactly the same shape as that of a corresponding rim of a spectacle frame. The thus obtained lens is fitted in a rim by interengagement of a V-shaped groove on the inner edge of the rim and the formed circumferential rib on the edge of the lens.

The groove on the inner edge of the spectacle frame rim is formed to have a spherical surface of a radius of curvature of the defined 5.5 curve (95.1 mm) as standard, but it is difficult to form a circumferential rib of such radius of curvature on the lens edge. Therefore, prior art working has been carried out with a radius of curvature only set approximately. In particular, prior art working into a noncircular but irregular shape with variation in the distance from the axis of the lens to the contact point of the grindstone with the edge of the lens was performed with difficulty resulting in a circumferential rib having unsmooth or, in extreme caes, stepped curvature at specified positions.

The prior art lens worked under the above-mentioned conditions was fitted in the spectacle frame rim inevitably with required extra steps of, for example, folding correctively the rim or manually correcting the rim shape.

SUMMARY OF THE INVENTION

The present invention provides a lens working apparatus permitting formation of a defect-free circumferential rib on the edge of a lens having an irregular contour (e.g., other than circular shape).

DETAILED DESCRIPTION OF AN EXEMPLARY PRESENTLY PREFERRED EMBODIMENT

The invention will be described in detail by way of the following example with reference to the accompanying drawings.

Figure 1:
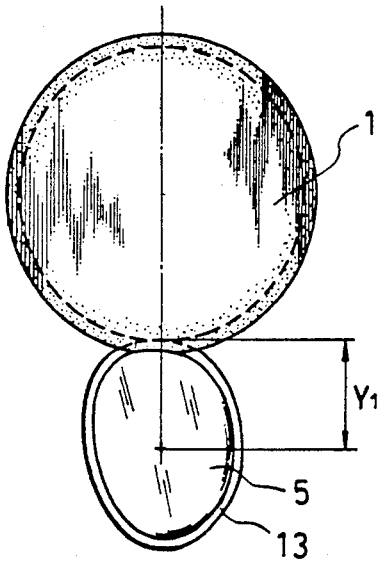
FIG. 1A is a side view illustrating positional relationship during working between a grindstone and a lens blank to be ground by it.
FIG. 1B is a plan view of FIG. 1A.
Figure 1:
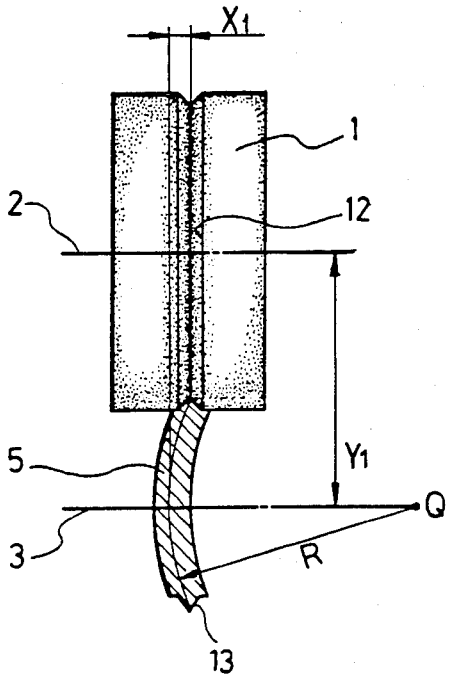
Figure 2:
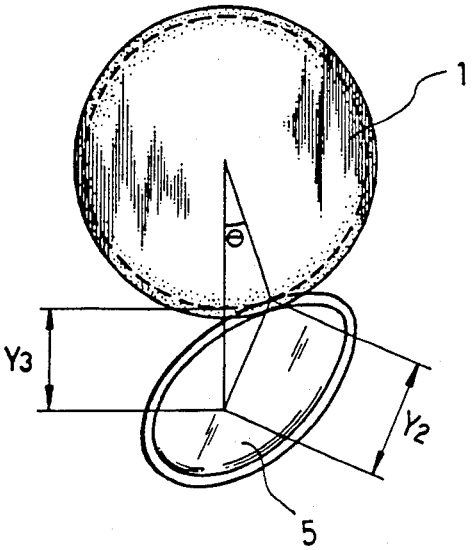
FIG. 2 is a side view similar to FIG. 1A, illustrating another positional relationship.
Figure 3:
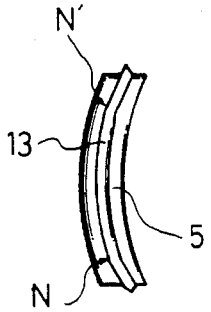
FIG. 3A is a plan view of a formed lens.
FIG. 3B is a side view of the same lens of FIG. 3A.
Figure 3:
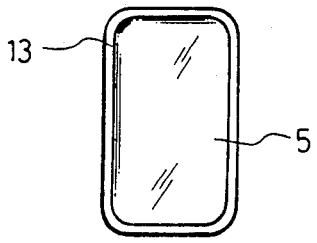

FIGS. 1A and 1B are views illustrating a positional relationship between a lens blank 5 and a rotary grindstone 1 during the working of forming a circumferential rib on the edge of the lens. Reference characters designate the following: 2 is the shaft of the grindstone, 3 is the axis of the lens blank, 12 is a V-shaped groove for forming a circumferential rib 13 on the edge of the lens blank and Q is the center of curvature of a spectacle frame rim in which the lens is to be fitted. In the prior art, the amount to move the lens blank in its axial direction (corresponding to the shift "X" of the center Q of curvature of the lens blank 5) was determined approximately on the basis of distance $Y_1$ between the shaft 2 of the grindstone 1 and the axis 3 of the lens blank 5 and applied to the lens working. If the line linking the centers of the lens blank and the grindstone inclines at an angle $\theta$ to the line running from the center of the grindstone 1 to the contact point of it with the lens blank 5, as illustrated in FIG. 2, determination of the shift $X_1$ should be based on distance $Y_1$ but has depended, without exception, on the distance $Y_3$, resulting in the formation of a circumferential rib 13 having sharply acute and undesirable curvature at specified points N and N', as shown in FIGS. 3A (plan view) and 3B (side view).

In addition, recent fashion of glasses has dictated various shapes of frames, often requiring varying distance from the axis of a lens to its edge. For such glasses frames the present invention determines distance $X_1$ as defined in FIG. 1B (while shifting the lens blank 5 in its axial direction (X direction) and in the perpendicular direction to the axis (Y direction)) on the basis of distance $Y_2$ as indicated in FIG. 2. This feature of the present invention permits a circumferential rib with radius of curvature as required to be accurately formed.

Figure 4:
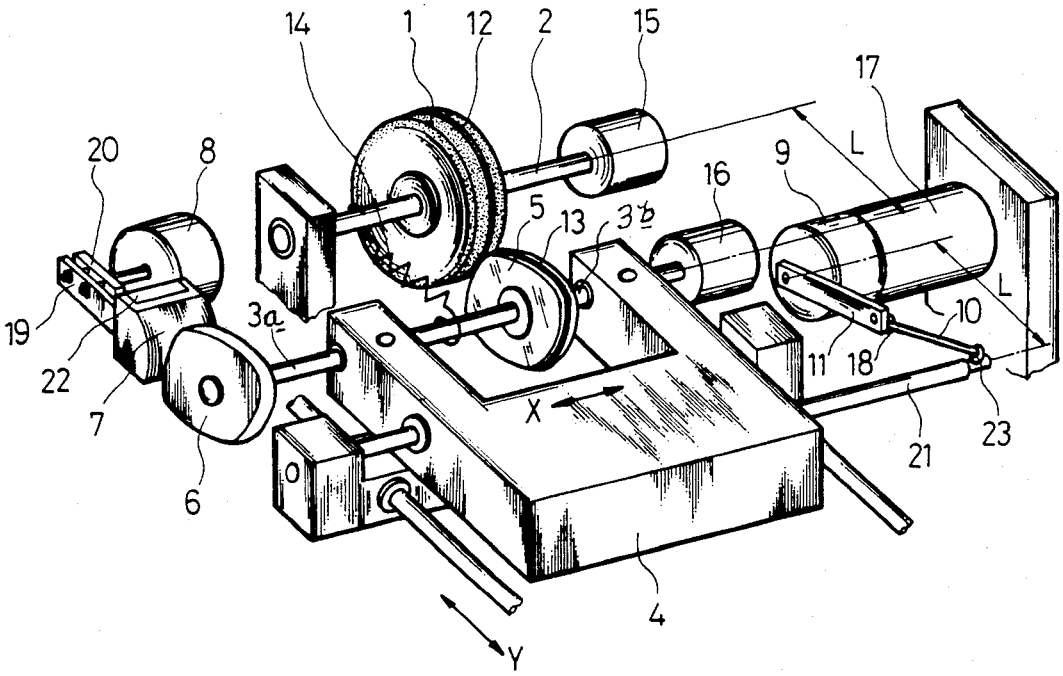
FIG. 4 is a perspective view of an embodiment of lens working apparatus according to the invention.
Figure 5:
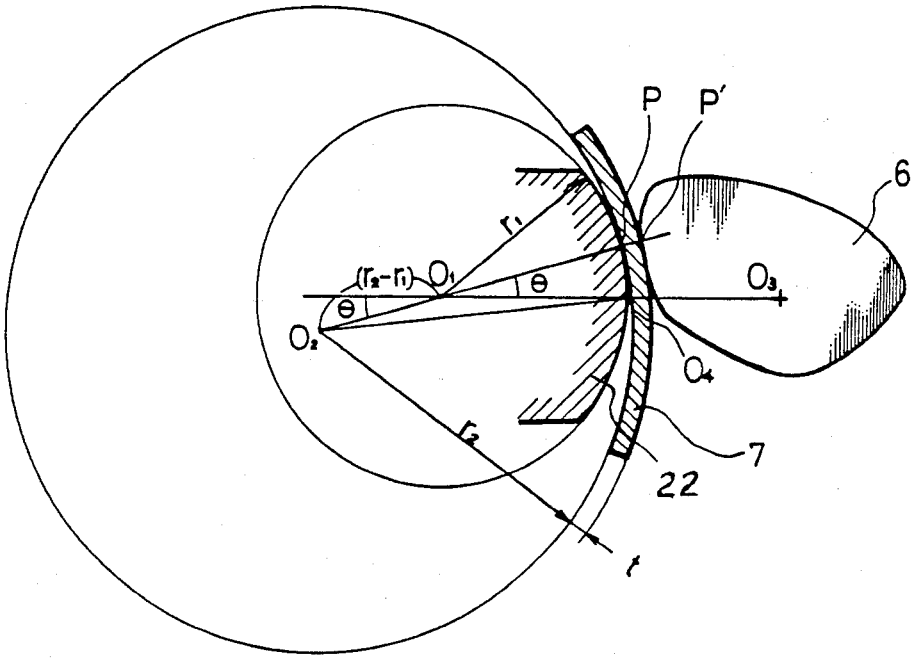
FIG. 5 is a side view illustrating the mechanism of detecting the contact angle of a lens blank and grindstone.
Figure 6:
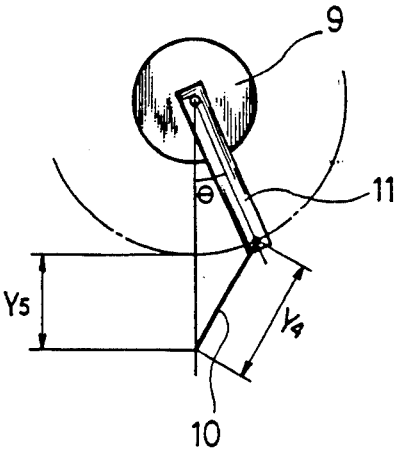
FIG. 6A is a side view of a controller and a slider-crank mechanism attached thereto.
FIG. 6B is a plan view of FIG. 6A.
Figure 6:
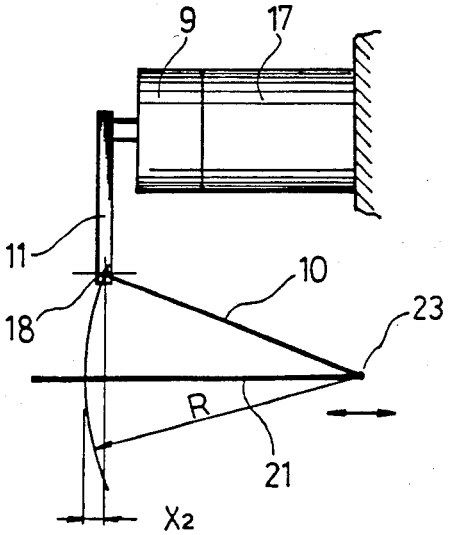

The apparatus according to the present invention is as follows:

FIG. 4 shows a perspective view of an entire lens working apparatus (illustrated schematically), and FIG. 5. a side view illustrating the theory of the mechanism for determining a contact angle of the lens blank to the grindstone. FIG. 6A is a side view of a crank mechanism attached to a controller 9 and FIG. 6B a plan view of the same crank mechanism.

Referring to FIG. 4, the lens working apparatus comprises a rotary grindstone 1 and X-Y slidable lens blank carrier 4 with a pair of lens holding shafts 3A and 3B parallel to the grindstone shaft 2. The X-Y slidable lens blank carrier 4 is movable in an axial direction (X-direction) of the lens blank and in a perpendicular direction (Y-direction) to the former. The lens holding shafts 3A and 3B fixedly hold between them the lens blank 5 to be rotated and worked. The lens blank 5 is profiled (worked) by being urged against the periphery of the rotary grindstone 1. Lens holding shaft 3A also carries a lens model 6, against which a partner 7 is urged. The contact angle $\theta$ of the lens model 6 to the partner 7, (as defined in FIG. 5—the angle produced by the line running from the center $O_3$ of the lens model 6 to point $O_1$ corresponding to the center of the grindstone 1 and the line linking from point $O_1$ and the contact point P) is detected with a sensor 8, as further discussed below.

A controller 9 (or second sensor) is operably associated with the sensor 8, and accordingly operable depending on the defined contact angle O. Attached pivotally to the controller 9 at its end is a slider-crank mechanism consisting of a crank arm 11 (having a length equal to the radius of the rotary grindstone 1) and a connecting rod 10, pivotally jointed at its one end 18 with the crank arm 11 and at the other end 23 with a horn 21 projecting parallel to the lens blank axis 3 from the upper part of the X-Y slidable lens blank carrier 4. The connecting rod 10 has a length equal to the radius of curvature of the lens rim. Lens blank 5 is caused to shift in the axial direction of lens holding shafts 3A and 3B to permit shaping of an ideal circumferential rib, based on the controlled movement of X-Y slidable lens blank carrier 4.

The distance in the Y-direction between the axis of the controller 9 and the horn 21 is equal to distance L from the shaft 2 of the grindstone 1 to the lens holding shafts 3 (as shown in FIG. 4).

In operation, the rotary grindstone 1 mounted rigidly on the grindstone shaft 2 is rotated at a high speed (e.g., 3500 r.p.m.) by a grindstone-drive motor 15 through the shaft 2. The lens blank 5 to be worked (held securely between the pair of lens blank holding shafts 3A and 3B disposed parallel to the grindstone shaft 2) is driven to rotate at a low speed of about 6 r.p.m. by a lens drive motor 16. The lens model 6 is obviously rotated in synchronism with the lens blank 5 according to the locked shafts 3A and 3B.

The axis of the lens blank holding shafts 3A and 3B are adjusted in distance L in relation to shaft 2 of grindstone 1 by the X-Y slidable lens blank carrier 4, with spring 14 bridging between them and urging them toward each other to adequately press the lens blank against the grindstone 1.

The lens blank holding shaft 3A is provided at its end with a fixedly mounted lens model 6 which is urged against an associated partner 7. With rotation of the holder shafts, distance L thus varies continuously in accordance with the contour of the lens model 6.

With such continuous variation in distance L between the shafts 2 of the grindstone 1 and the lens blank holding shafts 3A and 3B, the lens blank 5 is ground by the rotary grindstone 1 with a V-shaped peripheral groove 12 and a circumferential rib 13 is thereby formed on the edge.

The contact angle $\theta$ of the lens 6 in relation to the model partner 7 can be detected by the sensor 8. With reference to FIG. 5, the lens model 6 is forced in contact at point P' with the model partner 7. The model partner 7 has an inner surface of circular arc about the center $O_2$ and with a radius of $r_2$, and a thickness of t. An inside member 22 with an outer surface of a circular arc with a radius $r_1$ is brought in contact at point P with the inner surface of the model partner 7. The center of the inner surface of the inside member 22, $O_1$, lies on the extension of the grindstone shaft 2. The distance from Point $O_1$ to the outer surface of the model partner 7, $r_1+t$ is equal to the curvature radius of the V-shaped groove 12 on the rotary grindstone 1.

$O_3$ is assumed to be the center of the lens blank. The circles of radius $r_1$ and $r_2$ are placed at point P in contact with each other, the three points, $O_1$, $O_2$ and P are resultingly on a straight line. Therefore, the contact angle $\theta$ made by the extension of a line $O_2$, $O_1$ and another straight line $O_1$, $O_3$ meeting at point $O_1$, is identical with $\theta$ of FIG. 2.

Referring to FIG. 4, the angle sensor 8 is a rotary potentiometer with a shaft passing through the center $O_1$ and parallel to the axis of the lens model 6 and lens blank 5. The shaft has at its end a crank arm 20 with an effective length equal to $r_2-r_1$. The crank arm 20 is pin-jointed at the other end corresponding to the center $O_2$ with another crank arm 19. This double crank arm mechanism provides the crank arm 20 (and in turn the sensor 8) with a resulting rotational angle the same degree as that of the above-described contact angle.

The controller 9, which is a rotary potentionmeter operably associated with the sensor 8, is caused to rotate with the action of a motor 17 controlled by the controller 9 and the operatively associated sensor 8. This results (as shown in FIGS. 6A and 6B) in rotation by $\theta$ of the crank arm 11, turning of the connecting rod 10 jointed with the arm 11 at one end of it, shift in the axial direction of the lens blank (X-direction) of the projecting horn 21 jointed with the connecting rod 10 at the other end 23 of it, and the X-directional sliding of the X-Y slidable carrier 4 carrying the lens blank 5. The lens working apparatus according to the present invention thereby permits precise working of a lens blank 5 into a lens with a desired circumferential rib on the edge.

What is claimed is:

1. A lens working apparatus, comprising:
a rotary grindstone having a driven shaft;
an X-Y slidable lens blank carrier having a pair of lens blank holding shafts disposed parallel to the shaft of said rotary grindstone, said shafts holding between them a lens blank to be rotatably worked by said grindstone to form a circumferential rib on said lens blank;
a lens model fixedly mounted on one of said lens blank holding shafts to be rotated thereby in fixed relation to rotation of said lens blank;
a model partner urged against said lens model;
a sensor for detecting a defined contact angle of said lens model with said model partner;
a controller operably associated with said sensor; and
a slider-crank mechanism, operated by an output of said controller, for shifting said X-Y slidable lens blank carrier in an axial direction of said lens blank, whereby the circumferential rib on the edge of said lens blank is thereby controllably formed.

2. A lens working apparatus as in claim 1, wherein:
said X-Y slidable carrier is slidable both in the axial direction of said lens blank and in a direction perpendicular to said axial direction.

3. A lens working apparatus as in claim 1, wherein:
said lens blank is worked by said rotary grindstone being urged against said lens blank.

4. A lens working apparatus as in claim 1, wherein:
said defined contact angle is an angle formed between a line linking the center of an inside member of said lens model partner defined by intersection with the axis of the shaft of said grindstone and the center of said lens model and a line linking the center of said lens model partner and the contact point of said lens model with said lens model partner.

5. A lens working apparatus as in claim 1, wherein:
said sensor for detecting the defined contact angle of said lens model includes a rotary potentiometer which provides a voltage output to said controller indicative of said defined contact angle.

6. A lens working apparatus as in claim 1, wherein:
said controller is physically connected with said X-Y slidable lens blank carrier through said slider-crank mechanism, the slider-crank mechanism comprising a crank arm having a length equal to the radius of said grindstone and a connecting rod having a length equal to the radius of curvature of a spectacle lens rim.

* * * * *